US009347719B1

(12) United States Patent
Stone

(10) Patent No.: US 9,347,719 B1
(45) Date of Patent: May 24, 2016

(54) REPLACEABLE FEED RAMP

(71) Applicant: RA Brands, L.L.C., Madison, NC (US)

(72) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 14/630,014

(22) Filed: Feb. 24, 2015

Related U.S. Application Data

(63) Continuation of application No. 14/590,370, filed on Jan. 6, 2015.

(60) Provisional application No. 61/926,473, filed on Jan. 13, 2014.

(51) Int. Cl.

| | |
|---|---|
| ***F41C 23/06*** | (2006.01) |
| ***F41A 9/55*** | (2006.01) |
| ***F41A 9/38*** | (2006.01) |
| ***F41C 23/18*** | (2006.01) |

(52) U.S. Cl.
CPC ... *F41A 9/55* (2013.01); *F41A 9/38* (2013.01); *F41C 23/06* (2013.01); *F41C 23/18* (2013.01)

(58) Field of Classification Search
CPC ..... F41C 23/06; F41C 23/18
USPC ..... 42/75.02
See application file for complete search history.

(56) References Cited

U.S. PATENT DOCUMENTS

| | | | |
|---|---|---|---|
| 1,387,889 | A | 8/1921 | Johnston |
| 1,735,160 | A | 11/1929 | Destree |
| 1,996,124 | A | 4/1935 | Rowley |
| 2,093,706 | A | 9/1937 | Browning |
| 2,186,582 | A | 1/1940 | Gebauer |
| 2,212,684 | A | 8/1940 | Hughes |
| 2,212,686 | A | 8/1940 | Hughes |
| 2,241,825 | A | 5/1941 | Page |
| 2,456,290 | A | 12/1948 | Ljutic |
| 2,497,861 | A | 2/1950 | Brown |
| 2,499,428 | A | 3/1950 | Tiffany |
| 2,554,618 | A | 5/1951 | Dixon |

(Continued)

FOREIGN PATENT DOCUMENTS

| | | |
|---|---|---|
| DE | 12114 | 1/1881 |
| DE | 4107675 | 9/1992 |

(Continued)

OTHER PUBLICATIONS

"Firing Pins", Bobs Gun Shop; http://www.gun-parts.com/firingpins.

(Continued)

*Primary Examiner* — Stephen M Johnson
(74) *Attorney, Agent, or Firm* — Womble Carlyle Sandridge & Rice, LLP

(57) ABSTRACT

A feed ramp system for feeding cartridges into the chamber of a firearm. The feed ramp system includes a feed ramp insert having a body with at least one attachment tab projecting therefrom. The feed ramp insert is received within a mating recess formed in the receiver and is removably coupled to the receiver to enable replacement of the feed ramp insert. The feed ramp insert includes a pair of proximal ramp surfaces that align with distal ramp surfaces form at a breech end of the firearm barrel, to define a pair of feed ramps for directing cartridges into the chamber.

17 Claims, 5 Drawing Sheets

(56) References Cited

U.S. PATENT DOCUMENTS 2,582,989 A 1/1952 Harvey
2,637,247 A 5/1953 Hester
2,655,837 A * 10/1953 Johnson ..... 89/33.2
2,712,192 A 7/1955 Dixon et al.
2,736,119 A 2/1956 Clarkson et al.
2,777,366 A 1/1957 Cook
2,887,013 A 5/1959 Marsh
2,918,847 A 12/1959 Barr
2,918,848 A 12/1959 Maillard
2,983,196 A 5/1961 Dixon
2,987,968 A 6/1961 Janson
3,106,138 A 10/1963 Thoma
3,125,930 A 3/1964 Gilbert
3,166,983 A 1/1965 Lizza
3,177,603 A 4/1965 Gillespie
3,207,036 A 9/1965 Norton
3,306,168 A 2/1967 Blumrick
3,397,473 A 8/1968 Browning
3,443,477 A 5/1969 Kaempf
3,444,641 A 5/1969 Ruger
3,478,417 A 11/1969 Shaw
3,486,411 A 12/1969 Lichtenstern
3,568,564 A 3/1971 Badali
3,584,533 A * 6/1971 Allyn ..... F41A 3/54 42/25
3,592,101 A 7/1971 Vartanian et al.
3,601,002 A 8/1971 Janson
3,601,009 A 8/1971 Burgess
3,675,534 A 7/1972 Beretta
3,680,434 A 8/1972 Muhlemann
3,690,219 A 9/1972 Muhlemann et al.
3,707,110 A 12/1972 Alday
3,709,092 A 1/1973 Tazome
3,711,980 A 1/1973 Palama
3,715,955 A 2/1973 Folley et al.
3,721,163 A 3/1973 Hill et al.
3,731,418 A 5/1973 Birkenhagen et al.
3,776,096 A 12/1973 Donovan
3,810,412 A 5/1974 Zamacola
3,945,296 A 3/1976 Hyytinen
3,988,964 A 11/1976 Moore
3,990,348 A 11/1976 Vesamaa
3,999,534 A 12/1976 Chapin et al.
4,014,247 A 3/1977 Tollinger
4,015,512 A 4/1977 Feerick
4,026,055 A 5/1977 Weast
4,058,922 A 11/1977 Elbe et al.
4,085,654 A 4/1978 Panigoni
4,098,016 A 7/1978 Foote
4,102,242 A 7/1978 Liedke
4,109,558 A 8/1978 Panigoni
4,125,054 A 11/1978 Jennie
4,126,077 A 11/1978 Quesnel
4,265,043 A 5/1981 Rowlands
4,307,652 A 12/1981 Witt et al.
4,316,339 A 2/1982 Herriott
4,373,423 A 2/1983 Moore
4,389,920 A 6/1983 Dufour, Sr.
4,395,838 A 8/1983 Civolani
4,409,883 A 10/1983 Nyst
4,414,880 A 11/1983 Throner
4,475,438 A 10/1984 Sullivan
4,505,183 A 3/1985 Grehl
4,538,502 A 9/1985 Benelli
4,545,285 A 10/1985 McLain
4,546,564 A 10/1985 ACosta
4,563,937 A 1/1986 White
4,590,843 A 5/1986 Huber
4,599,934 A 7/1986 Palmer
4,604,942 A 8/1986 Benelli
4,685,235 A 8/1987 Bunning et al.
4,702,146 A 10/1987 Ikeda et al.
4,709,617 A 12/1987 Anderson
4,765,224 A 8/1988 Morris
4,872,392 A 10/1989 Powers et al.
4,901,623 A 2/1990 Lee
4,930,396 A 6/1990 Johnson
4,941,277 A 7/1990 Lawlor
4,961,367 A 10/1990 Lindberg
5,173,564 A 12/1992 Hammond, Jr.
5,218,163 A 6/1993 Dabrowski
5,247,758 A 9/1993 Mason
5,272,956 A 12/1993 Hudson
5,274,939 A 1/1994 Scaramucci et al.
5,279,202 A 1/1994 Bellardi et al.
5,287,642 A 2/1994 Scaramucci
5,351,598 A * 10/1994 Schuetz ..... 89/185
5,367,940 A 11/1994 Taylor
5,404,790 A 4/1995 Averbukh
5,448,940 A 9/1995 Schuetz et al.
5,454,182 A 10/1995 Lewis et al.
5,471,777 A 12/1995 McDonald
5,476,028 A 12/1995 Seberger
5,479,737 A 1/1996 Osborne et al.
5,493,806 A 2/1996 Langevin et al.
5,499,569 A 3/1996 Schuetz
5,520,019 A 5/1996 Schuetz
5,726,377 A 3/1998 Harris et al.
5,737,865 A 4/1998 Brandl et al.
5,765,302 A 6/1998 Brandl et al.
5,767,434 A 6/1998 Hirtl et al.
5,768,815 A 6/1998 Casull
5,768,818 A 6/1998 Rustick
5,814,757 A 9/1998 Buss
5,824,943 A 10/1998 Guhring et al.
5,827,992 A 10/1998 Harris et al.
5,831,202 A 11/1998 Rustick
5,867,928 A 2/1999 Plebani
5,872,323 A 2/1999 Norton et al.
5,900,577 A 5/1999 Robinson et al.
5,907,919 A 6/1999 Keeney
5,911,173 A 6/1999 Westrom
5,913,669 A 6/1999 Hansen et al.
5,937,558 A 8/1999 Gerard
5,939,659 A 8/1999 Dobbins
5,945,626 A 8/1999 Robbins
5,959,234 A 9/1999 Scaramucci et al.
5,960,574 A 10/1999 Lameiras Guede
5,979,331 A 11/1999 Casull
5,983,549 A 11/1999 Battaglia
6,000,161 A 12/1999 Aalto
6,019,024 A 2/2000 Robinson et al.
6,029,645 A 2/2000 Wonisch et al.
6,044,748 A 4/2000 Westrom
6,123,007 A 9/2000 ODwyer
6,182,389 B1 2/2001 Lewis
6,240,670 B1 6/2001 Findlay
6,243,978 B1 6/2001 Vignaroli et al.
6,318,230 B1 11/2001 Bamber
6,347,569 B1 2/2002 Butler
6,357,155 B1 3/2002 Amadini
6,374,528 B1 4/2002 Davis et al.
6,374,720 B1 4/2002 Tedde
6,381,895 B1 5/2002 Keeney et al.
6,382,073 B1 5/2002 Beretta
6,418,655 B1 7/2002 Kay
6,421,946 B1 7/2002 LoRocco
6,470,616 B1 10/2002 Clay
6,484,430 B1 11/2002 Robinson et al.
6,508,160 B2 1/2003 Beretta
6,536,150 B2 3/2003 Schweikart
6,560,908 B2 5/2003 Murello
6,564,691 B2 5/2003 Butler
6,574,898 B2 6/2003 Spencer et al.
6,604,314 B2 8/2003 Fluhr
6,606,934 B1 8/2003 Rock et al.
6,609,319 B1 8/2003 Olson
6,619,592 B2 9/2003 Vignaroli et al.
6,655,372 B1 12/2003 Field et al.
6,662,485 B2 12/2003 Kay
6,715,396 B2 4/2004 Dionne
6,722,254 B1 4/2004 Davies
6,752,062 B2 6/2004 Vais
6,775,942 B2 8/2004 Compton

(56) References Cited

U.S. PATENT DOCUMENTS

| | | | | |
|---|---|---|---|---|
| 6,834,455 | B2 | 12/2004 | Burigana | |
| 6,886,286 | B2 | 5/2005 | Dowding | |
| 6,889,461 | B2 | 5/2005 | Vignaroli et al. | |
| 6,899,008 | B2 | 5/2005 | Breuer | |
| 6,966,137 | B2 | 11/2005 | Gussalli Beretta | |
| 6,971,202 | B2 | 12/2005 | Bender | |
| 7,032,339 | B1 | 4/2006 | Bounds | |
| 7,143,680 | B2 | 12/2006 | Bender | |
| 7,162,822 | B1 | 1/2007 | Heayn et al. | |
| 7,162,823 | B2 | 1/2007 | Schoppman et al. | |
| 7,252,138 | B2 | 8/2007 | Burkhalter et al. | |
| 7,287,456 | B2 | 10/2007 | Spielberger | |
| 7,311,032 | B2 | 12/2007 | Murello | |
| 7,343,844 | B2 | 3/2008 | Poff, Jr. | |
| 7,395,626 | B2 | 7/2008 | Zedrosser | |
| 7,418,898 | B1 | 9/2008 | DeSomma | |
| 7,448,307 | B1 | 11/2008 | Dafinov | |
| 7,461,581 | B2 | 12/2008 | Leitner-Wise | |
| 7,467,581 | B2 | 12/2008 | Botty | |
| 7,469,624 | B1 | 12/2008 | Adams | |
| 7,478,494 | B2 | 1/2009 | Zeh | |
| 7,516,570 | B2 | 4/2009 | Stone | |
| 7,596,900 | B2 | 10/2009 | Robinson et al. | |
| 7,627,974 | B2 | 12/2009 | Olson | |
| 7,735,410 | B2 | 6/2010 | Clark | |
| 7,775,150 | B2 | 8/2010 | Hochstrate et al. | |
| 7,779,740 | B1 | 8/2010 | Holmes et al. | |
| 7,810,272 | B2 | 10/2010 | Brixius | |
| 7,823,314 | B1 | 11/2010 | Wheatley | |
| 7,866,079 | B2 | 1/2011 | Keeney et al. | |
| 7,946,214 | B2 | 5/2011 | Stone | |
| 7,954,414 | B2 | 6/2011 | Dueck et al. | |
| 8,069,600 | B2 | 12/2011 | Rousseau et al. | |
| 8,096,074 | B2 | 1/2012 | Robinson et al. | |
| 8,109,194 | B2 | 2/2012 | Stone | |
| 8,240,074 | B2 | 8/2012 | Vuksanovich | |
| 8,250,964 | B2 | 8/2012 | Stone | |
| 8,490,312 | B2 | 7/2013 | Barrett et al. | |
| 8,505,227 | B2 | 8/2013 | Barrett et al. | |
| 8,522,465 | B2 | 9/2013 | Jarboe et al. | |
| 8,539,708 | B2 | 9/2013 | Kenney et al. | |
| 8,887,426 | B2 | 11/2014 | Feese et al. | |
| 2001/0054350 | A1 | 12/2001 | Beretta | |
| 2002/0073832 | A1 | 6/2002 | Vignaroli et al. | |
| 2002/0096042 | A1 | 7/2002 | Adkins | |
| 2002/0139362 | A1 | 10/2002 | Shipachev et al. | |
| 2005/0016374 | A1 | 1/2005 | Pescini | |
| 2005/0188590 | A1* | 9/2005 | Baber et al. | 42/75.02 |
| 2005/0188591 | A1 | 9/2005 | Stone | |
| 2005/0223613 | A1 | 10/2005 | Bender | |
| 2005/0235817 | A1 | 10/2005 | Murello | |
| 2005/0257681 | A1 | 11/2005 | Keeney et al. | |
| 2005/0262752 | A1* | 12/2005 | Robinson et al. | 42/71.01 |
| 2005/0268516 | A1 | 12/2005 | Nelson | |
| 2006/0065112 | A1 | 3/2006 | Kuczynko et al. | |
| 2006/0283318 | A1 | 12/2006 | Beaty | |
| 2007/0012169 | A1 | 1/2007 | Gussalli | |
| 2008/0092733 | A1 | 4/2008 | Leitner-Wise et al. | |
| 2008/0209788 | A1 | 9/2008 | Olson | |
| 2010/0269390 | A1* | 10/2010 | LaTorre et al. | 42/49.01 |
| 2010/0275493 | A1 | 11/2010 | Polovnev et al. | |
| 2011/0005383 | A1 | 1/2011 | Kramer | |
| 2011/0168009 | A1 | 7/2011 | Robb et al. | |
| 2012/0073179 | A1 | 3/2012 | Young | |
| 2012/0180648 | A1 | 7/2012 | Sullivan et al. | |
| 2012/0228052 | A1 | 9/2012 | Findlay | |
| 2013/0061501 | A1 | 3/2013 | Pflaumer et al. | |
| 2013/0145669 | A1* | 6/2013 | Zonshine | 42/75.02 |
| 2014/0115938 | A1 | 5/2014 | Jarboe | |
| 2014/0150638 | A1 | 6/2014 | Ricks | |

FOREIGN PATENT DOCUMENTS

| | | |
|---|---|---|
| DE | 4136665 | 5/1993 |
| DE | 19903327 | 8/2000 |
| EP | 1215464 | 6/2002 |
| EP | 1380808 | 1/2004 |
| EP | 1624275 | 2/2006 |
| EP | 1709384 | 10/2006 |
| FR | 2686152 | 7/1993 |
| GB | 214505 | 4/1924 |
| GB | 617142 | 2/1949 |
| GB | 1405189 | 9/1975 |
| HU | 227243 | 12/2010 |
| RU | 2089811 | 9/1997 |
| WO | WO 2005/119160 | 12/2005 |
| WO | WO 2008/108786 | 9/2008 |
| WO | WO 2009/061546 | 5/2009 |
| WO | WO 2010/151549 | 12/2010 |
| WO | WO 2014/150956 | 9/2014 |

OTHER PUBLICATIONS

Army Universal Assault Rifle "Steyr" Semi-Automatic Manual; Steyr Mannlicher GmbH; http://nazarian.no//images/wep/182_Steyr_AUG.pdf.

Operators Manual for P7 Pistols; Heckler & Koch, Inc.; Mar. 2007; Trussville, Alabama; http://www.hk-usa.com/-images/shared/P7_Ops_Manual_Trussville.

"AR-15 Extractor Upgrade"; 1 page; Dillon Precision Products, Inc.; http://www.dillonprecision.com/content/p/9/pid/24687/catid/17/AR_15_Extractor_Upgrade.

"Extractor Spring Insert for AR15 / M16", http://www.windhamweaponry.com/shopexd.asp?id=140 (accessed Mar. 5, 2013).

"LMT O-Ring", http://www.mcssl.com/store/center-mass/catalog/product/37cbf23c1224aeba55a6d322bd701ea (accessed Feb. 27, 2013).

"SLR 15 Rifle Specs-Extractor/Extraction System"; 3 pages; http://www.slrrifels.com.

"Ultimate Extractor Upgrade"; http://sixsigmaarms.com/products.php?d=3 (accessed Mar. 7, 2013).

International Search Report dated Sep. 8, 2014 for PCT/US2014/024646 filed Mar. 12, 2014.

International Search Report for International Application No. PCT/US2007/012364, dated Oct. 27, 2008.

International Search Report for International Application No. PCT/US2008/074601, dated Jul. 21, 2009.

International Search Report for International Application No. PCT/US2010/027916, dated Jun. 21, 2010.

International Search Report for International Application No. PCT/US2010/039526, dated Sep. 3, 2010.

Jeff Chudwin; D-Fender? Whats that? Does it really enhance extraction?; 1 page endorsement by Chief of Police, Olympia Fields P.D.

MGI D-Fender Advertisements: 1 page; http://Google Images.com.

The MGI D-Fender D-Ring Brochure; 1 page; www.mgi-military.com; MG Industries; Bangor, Maine.

Written Opinion dated Sep. 8, 2014 for PCT/US2014/024646 filed Mar. 12, 2014.

Written Opinion for International Application No. PCT/US2007/012364, dated Oct. 27, 2008.

Written Opinion for International Application No. PCT/US2008/074601, dated Jul. 21, 2009.

Written Opinion for International Application No. PCT/US2010/027916, dated Jun. 21, 2010.

Written Opinion for International Application No. PCT/US2010/039526, dated Sep. 3, 2010.

Extended European Search Report dated Jun. 6, 2015 for European Application No. EP15150667.2.

* cited by examiner

REPLACEABLE FEED RAMP

CROSS REFERENCE TO RELATED APPLICATIONS

The present Patent Application is a continuation of previously filed co-pending U.S. patent application Ser. No. 14/590,370, filed Jan. 6, 2015, which application claims benefit of U.S. Provisional Patent Application Ser. No. 61/926,473, filed Jan. 13, 2014 according to the statutes and rules governing provisional patent applications, particularly 35 U.S.C. §119(e) and 37 C.F.R. §1.78(a)(3)-(4). The specifications and drawings of each of said applications referenced above are specifically incorporated herein by reference as if set forth in their entireties.

TECHNICAL FIELD

The present disclosure relates generally to firearms and, in particular, to a feed ramp assembly for directing cartridges into the chamber of a firearm.

BACKGROUND

Fire control mechanisms and actions for modern auto-loading firearms are generally highly-engineered mechanical devices that are designed with tight spacings/tolerances, and necessarily must operate reliably for a high number of firing cycles. For example, automatic and/or semi-automatic firearms, such as M16/AR15, M4, and AK-47 auto-loading rifles generally are required to fire thousands of rounds, especially for military uses such as under battlefield conditions, without failure. During firing of such auto-loading firearms, as the spent casing is ejected, a new round of ammunition will be received from a magazine and loaded into the chamber of the firearm. As the bolt is moved forward and pushes the round of ammunition into the chamber, the bolt generally undergoes a partial rotation so as to engage a series of locking lugs with a series of barrel lugs, thereby locking the bolt into position and sealing the round of ammunition within the chamber.

Feed ramps generally are used to guide the rounds of ammunition from the magazine into the chamber, and are typically machined into the material of the barrel or barrel extension that surrounds the breech opening, such as by enlarging or expanding one or more of the gaps that separate the barrel lugs, and, in rifles such as the M4, can extend into/be matched with feed ramps formed in the upper receiver. During a loading operation, the ammunition cartridges rub against the feed ramp, causing peening, galling or wear of the feed ramp surfaces, especially tamp surfaces formed in the receiver, which typically can be formed from metals such as aluminum that provide a reduction in weight but have lower impact toughness than steel or similar materials. Dirt and debris further can be trapped at the feed ramp surfaces, causing additional or faster wearing of the ramp surfaces, and/or leading to jams or failure of the feed ramp. Thus, polishing and repair of feed ramps can be required on a frequent basis to maintain such auto-loading firearms. Additionally, it is becoming increasingly popular for many firearms, in particular for military or tactical uses, to be modifiable to the different types of ammunition, and thus, it is necessary that the surfaces of the feed ramps be able to accommodate the use of such ammunition.

Accordingly, there exists a need for an improved feed ramp system for directing cartridges into a chamber of the firearm that provides for a reduction in wear and galling on the interior surfaces thereof. It is to the provision of a solution to this and other problems that the present disclosure is primarily directed.

SUMMARY

Generally described, the present disclosure relates to a feed ramp system for directing cartridges into the firing chamber of a firearm. The feed ramp system generally will include a replaceable feed ramp that can be removably mounted adjacent the breech end of a barrel of the firearm. The firearm barrel will include a bore that extends along a longitudinal axis from its first or breech end and a muzzle end. A barrel extension can be mounted at the breech end, including a breech face that leads to a chamber formed in the barrel. The breech face is defined by a circumferential rim and includes a plurality of barrel lugs extending radially inwardly from the circumferential rim and that are spaced from each other by a plurality of lug gaps. The circumferential rim further can include a notch or recess defined in a lower portion thereof and along which enlarged and/or sloped gap surfaces can be defined, which can thus form a pair of distal ramp surfaces in the barrel or barrel extension.

The feed ramp system includes a feed ramp insert having a body formed from a high strength, wear resistant material. In one embodiment, the material of the insert generally can include a metallic material that is different from the metallic material of the receiver. The insert body will be configured to be removably coupled to the receiver and can include a central guide section or ramp portion configured to be received and extend into the notch in the breech face or the barrel or barrel extension. A pair of proximal ramp surfaces generally will be formed in the guide section, the ramp surfaces being sloped relative to the longitudinal axis. The proximal ramp surfaces further can be configured to align with the distal ramp surfaces of the breech face of the barrel or barrel extension to form the firearm feed ramp structure for directing cartridges into the chamber of the firearm.

Another embodiment of the present disclosure includes a feed ramp insert for a firearm having a barrel and/or a barrel extension with a breech face adjacent a chamber, a receiver coupled to the barrel, and a bolt moveable within the receiver to move a cartridge from a magazine into the chamber through the breech. The breech face of the barrel or barrel extension is defined by a circumferential rim and includes a plurality of barrel lugs extending radially inward from the circumferential rim and spaced from each other by a plurality of lug gaps. The breech face further can include a notch extending axially through the circumferential rim and along which a pair of distal ramp surfaces can be formed.

The feed ramp insert includes an insert body that will be configured for installation within the receiver, generally being received in a mating aperture or recess formed along a front face of the receiver, and which can further be received in a mating engagement with the notch of the barrel breech face. One or more attachment tabs or members can extend from the insert body, and can receive locking pins, fasteners or other, similar elements, to removably couple the insert body to the receiver. A pair of proximal ramp surfaces also is formed into the insert body, the ramp surfaces generally being sloped relative to the longitudinal axis of the barrel. The proximal ramp surfaces can be configured to align with the distal ramp surfaces of the barrel breech face to form combined or composite feed ramp surfaces for directing cartridges into the chamber.

The specific structures and techniques employed to improve over the drawbacks of the prior devices and accomplish the advantages described herein will become apparent from the following detailed description of representative embodiments and the appended drawings and claims.

Figure 1:
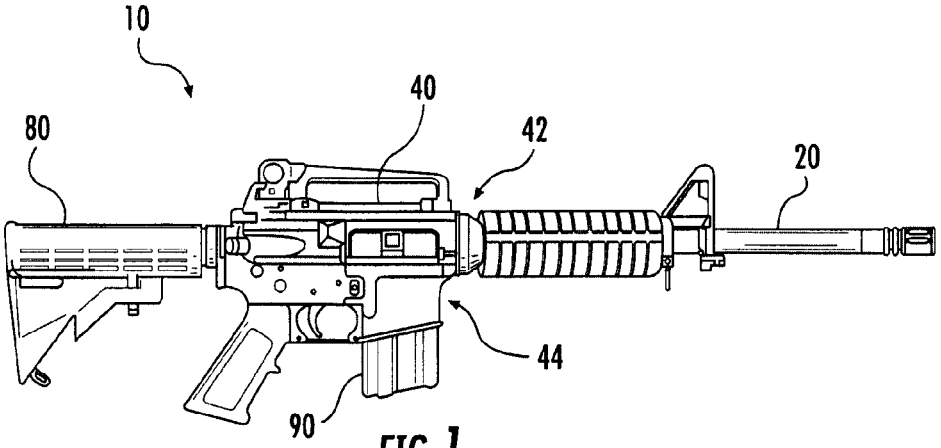
FIG. 1 is a side view of a representative firearm that includes the feed ramp system of the present disclosure.

Those skilled in the art will appreciate and understand that, according to common practice, various features of the drawings discussed below are not necessarily drawn to scale, and that dimensions of various features and elements of the drawings may be enlarged or reduced to more clearly illustrate the embodiments of the present invention described herein.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION OF REPRESENTATIVE EMBODIMENTS

It is to be understood that the invention of the present disclosure is not limited to the specific devices, methods, conditions, or parameters of the representative embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

Generally described, the present disclosure relates to a feed ramp system for directing cartridges into a chamber of the firearm, shown here as an auto-loading rifle. It is to be appreciated, moreover, that applications of the feed ramp system are not limited to auto-loading rifles, and may include bolt action or lever action rifles and the like, auto-loading or pump action shotguns and the like, and other varieties of pistols and firearms. As described below, the feed ramp system of the present disclosure can provide several significant advantages and benefits over other feed ramp systems and methods for loading rounds of ammunition into the chamber of the firearm. However, the recited advantages are not meant to be limiting in any way, as one skilled in the art will appreciate that other advantages may also be realized upon practicing the present disclosure.

FIG. 1 is a side view of a representative firearm that in which the feed ramp system 5 of the present disclosure can be used. In one embodiment, as shown in FIG. 1, the firearm can be an auto-loading, semi-automatic rifle 10, such as an M4 or AR-15, in which the breech end 22 of a barrel 20 is received and coupled to the forward end 42 of a receiver 40. In the illustrated embodiment, the barrel also can include a barrel extension 26 which is received between the breech end of the barrel and the forward end 42 of the receiver. It will, however, be understood that the feed ramp system 5 is not limited to use in firearms with a barrel extension, but also can be used in firearms without a barrel extension mounted to the barrel.

As shown in FIG. 1, the firearm 10 further can include a stock 80 coupled to the back end 48 of the receiver 40, and a fire control 11, including a trigger 12. As also shown in FIG. 1, a magazine 90 containing rifle cartridges or rounds of ammunition (shown in phantom lines 15 in FIG. 2 and shown in FIG. 4B) can be received with a magazine well 44 that is generally located in the bottom of the receiver for containing a supply of cartridges for feeding to the chamber 25 of the firearm. As understood by those of skill in the art, the receiver 40 will include an action, including a bolt 41 (FIG. 4B) that operates, during the loading portion of the action cycle, to move a cartridge 15 from the magazine through the breech opening 30 of the barrel 20, or the barrel extension 26, and into the chamber 25 formed within the breech end 22 of the barrel.

Figure 2:
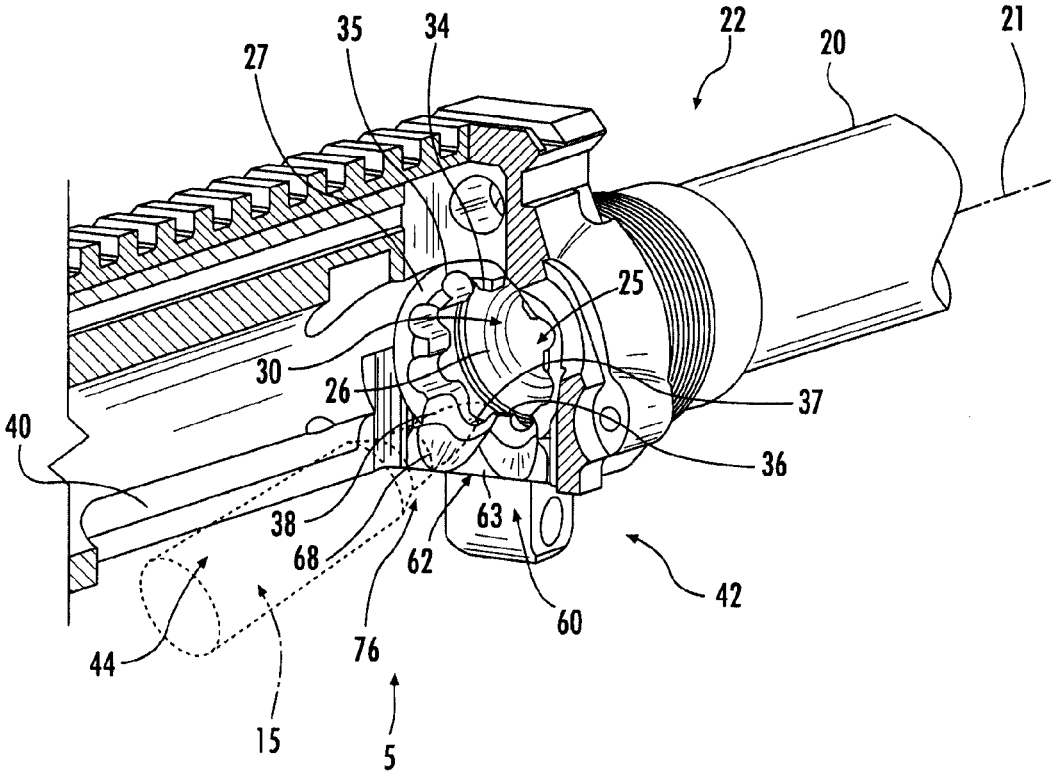
FIG. 2 is a perspective, cut-away view of the assembled feed ramp system, in accordance with one representative embodiment.

FIG. 2 is a perspective, cut-away view of the breech end 22 of the barrel 20 and barrel extension 26 as assembled/coupled to the forward end 42 of the receiver 40, and illustrates one embodiment of the feed ramp system of the present disclosure. The barrel 20 will include a bore formed along a longitudinal axis 21 with a breech opening 30 formed in a first, breech or proximal end face 27 of the barrel extension 26 (or the barrel where a barrel extension is not used), and which leads to the chamber 25 formed at the breech end of the barrel. The breech face 27 can be defined by a circumferential rim 32, and generally includes a plurality of barrel locking lugs 34 extending radially inward from the circumferential rim 34 and spaced from each other by a plurality of locking lug gaps 35. The barrel lugs 34 are configured to engage with a plurality of complimentary locking lugs 45 (FIG. 4B) that are formed into the head end of the bolt 41 that is housed within and is movable along the receiver 40. During the loading portion of the firing cycle, the locking lugs on the breech bolt pass through the lug gaps 35 between the barrel lugs 34 as the bolt pushes a round of ammunition into the chamber, after which the bolt is partially rotated to engage its locking lugs with the barrel lugs 34. This interconnection locks the breech bolt into position and seals the chamber in preparation for firing.

One or more of the lug gaps 37, typically located along a lower portion of the breech face 27, adjacent the opening or portion of the receiver through which the cartridges from the magazine are received for feeding to the chamber, can be machined or enlarged to form one or more distal ramp surfaces 38. These distal ramp surfaces 38 generally can be formed at a first angle or slope relative to the longitudinal axis 21 of the barrel 20. The distal ramp surfaces 38 can form the upper portion of one or more bifurcated or combination firearm feed ramps 76 that can be used to direct cartridges from the magazine into the chamber of the firearm.

In one embodiment of the feed ramp system as shown in FIGS. 2-4A, two lug gaps 37 that are adjacent to and surrounding the lower center barrel lug 36 can be machined or enlarged to form the upper portions or distal ramp surfaces 38 for two bifurcated or combination feed ramps 76. Moreover, the distal ramp surfaces 38 can be configured and/or angled to mate with corresponding proximal feed ramp surfaces 68 of the feed ramps 76 that can be formed into a feed ramp insert 60 that has been removably positioned within a notch 28 formed into the circumferential rim 32 of the barrel 20. In one aspect, the feed ramp insert 60 can also be received within a mating aperture or recess formed along an inside face 52 of the receiver 40.

Figure 3:
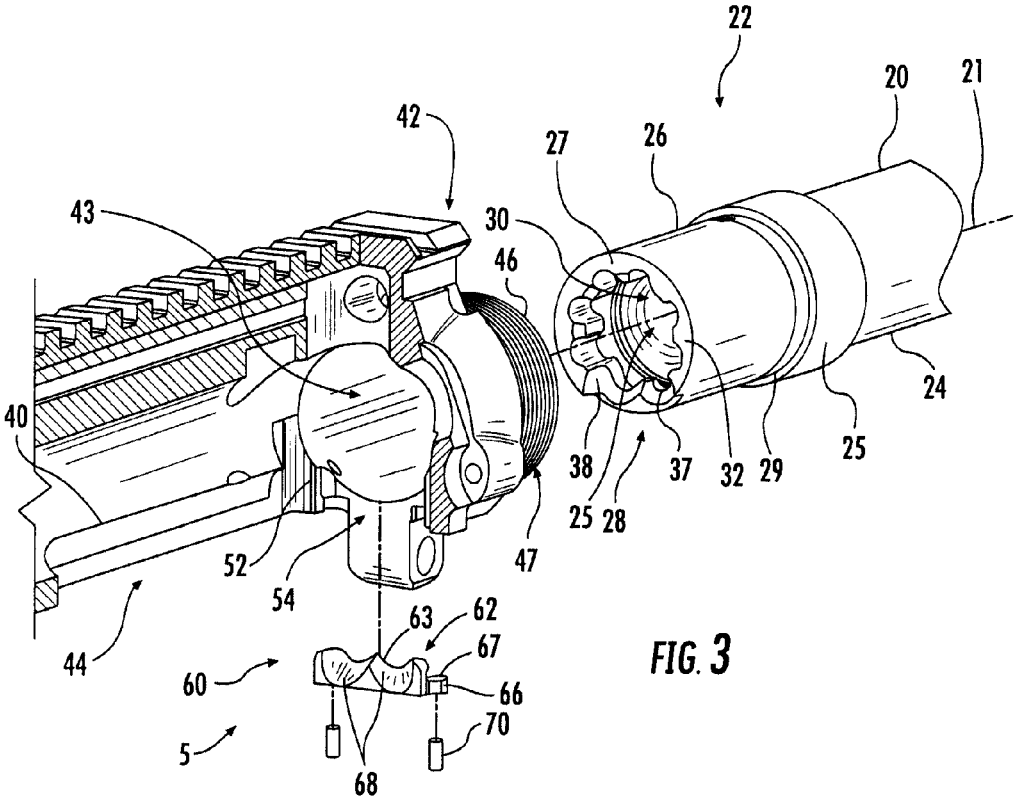
FIG. 3 is an exploded perspective view of the feed ramp system of FIG. 2.

FIG. 3 shows an exploded perspective view of the representative embodiment of the feed ramp system 5 of FIG. 2, and illustrates the structural relationships between the breech end 22 of barrel 20, the front end 42 of the receiver 40, and the feed ramp insert 60. To assemble the barrel 20 to the receiver 40, the breech end 22 of the barrel/barrel extension is generally received and installed within a forward opening 43 formed in the inside face 52 at the front end 42 of the receiver, with an outwardly-projecting boss or shoulder 25 abutting the forward end of the receiver. A barrel nut (not shown) can be slid rearwardly over the boss and screwed onto a threaded portion 47 of the receiver and tightened to secure the barrel/barrel extension to the receiver 40. In this configuration, the breech face 27 generally is received inside the receiver and aligned with the interior axial surface 52 of the receiver, as shown in FIG. 2.

Figure 5A:
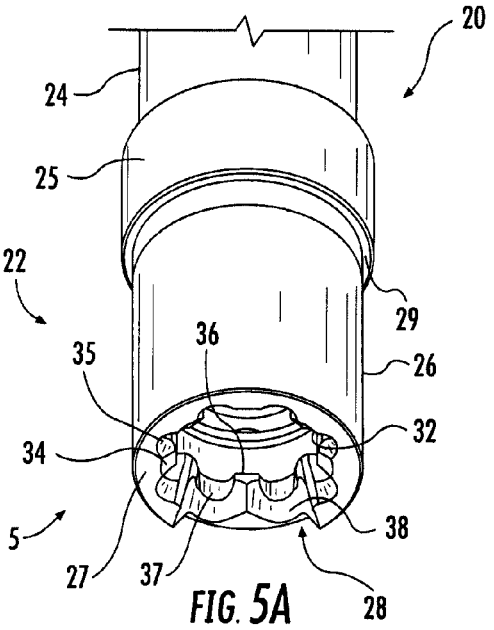
FIG. 5A is a perspective view of the breech end of the barrel of the feed ramp system of FIGS. 2-3.
Figure 5B:
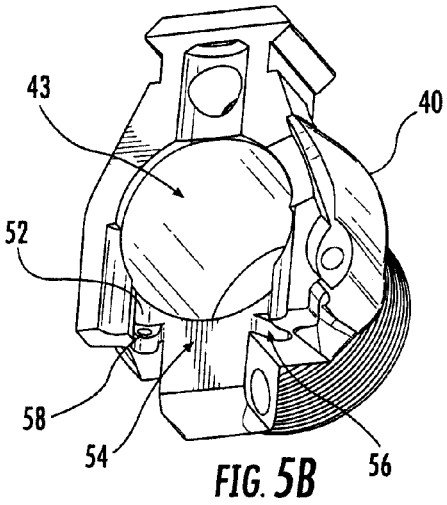
FIG. 5B is a perspective view of the replaceable feed ramp of the feed ramp system.
Figure 6:
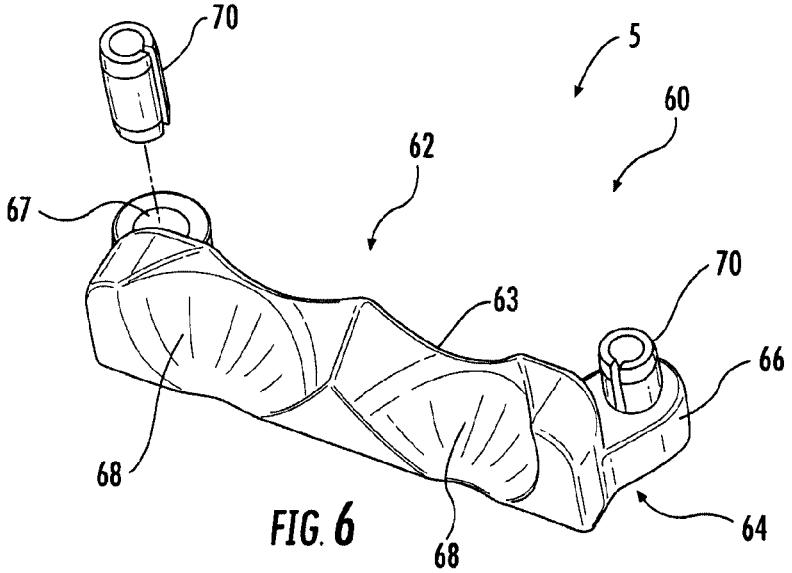
FIG. 6 is a perspective view of the portion of the receiver of the firearm at which the feed ramp of FIGS. 2-4A and 5A is mounted.
Figure 7:
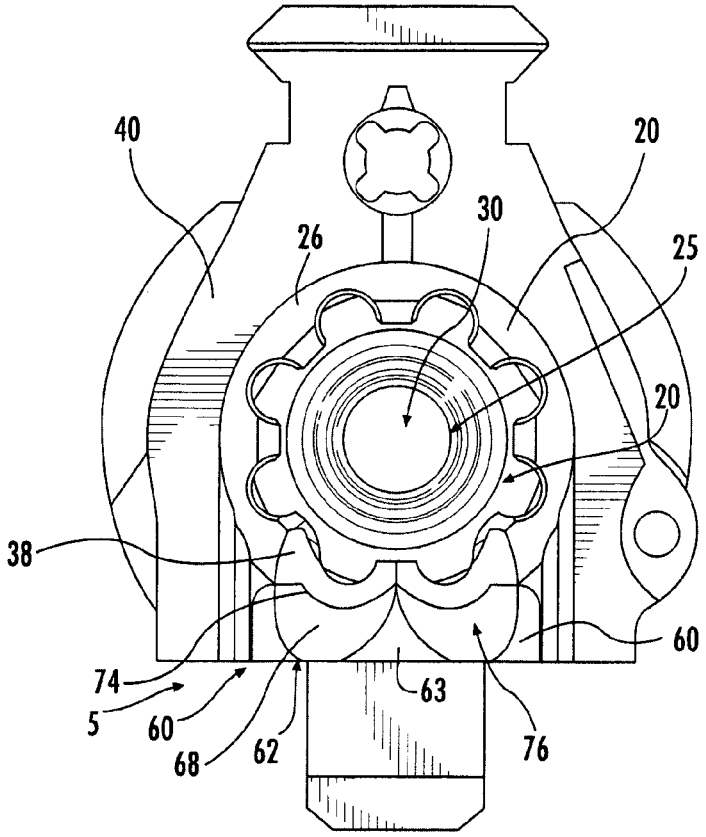
FIG. 7 is an end view of the feed ramp system of FIGS. 2-3.

As shown in the embodiment illustrated in FIGS. 3 and 6-7, the feed ramp insert 60 can include an insert body 62, which can include central portion of guide section 63 configured and/or sized to fit within a mating recess or notch 54 formed into the interior axial surface 52 of the receiver 40 (FIG. 5B), the recess 54 generally being sized and shaped to accommodate the outer dimensions of the feed ramp insert. The insert body can be received in the mating recess 54 is a substantially tight, tolerance fitted relationship, as indicated in FIGS. 2-3. In addition, the insert body can have one or more attachment tabs, projections or similar members 66 that project from the central portion of the insert body, and include fastener ports or apertures 67 formed therein, as indicated in FIG. 6. As also illustrated in the FIGS, a pair of locking elements, in one embodiment including slotted spring pins 70, or other, similar fasteners that can be received within the apertures 67 and within corresponding fastener openings or apertures formed in the receiver adjacent the interior face 52 thereof to removably couple the feed ramp insert 60 to the receiver 40.

To accommodate the feed ramp insert 60, the notch 28 of the barrel extension/barrel can be formed in the breech face 27 of the barrel 20 and extended axially through the circumferential rim 32 to at least partially shorten the one or more lug gaps 37 that have been enlarged to form a distal ramp surface(s) 38. In embodiments shown in FIGS. 3 and 4A, the notch 28 can at least partially shorten the lower center barrel lug 36 and both of the two enlarged lug gaps 37. In another aspect, the notch 28 can also cut partially into the barrel lugs located to either side of the lower center barrel lug 36 while leaving their overall length substantially unchanged. The distal ramp surfaces 38 that result from the enlarged lug gaps 37 can also partially encroach into the barrel lugs located to either side of the lower center barrel lug 36.

Upon assembly of the barrel 20 with the receiver 40, the notch 28 in the barrel 20 can become aligned with the mating recess 54 formed in the receiver. The central guide section of the insert body 62 can be matingly received within the aligned notches/recesses 28 and 54, in a tolerance fit, with the attachment tabs 66 of the insert body generally being aligned with and/or engaged and received within attachment slots 56. The attachment slots 56 generally can be formed in an underside surface of the receiver and can be configured to receive attachment tabs 66 that extend laterally from the body of the feed ramp insert 60 (FIG. 6). Once installed, the fastener holes of the insert body attachment tabs will be aligned with the attachment holes 57 in the underside of the receiver 40 so as to receive the locking elements or fasteners 70 (FIG. 3) to couple the feed ramp insert 60 to the receiver 40.

As noted above and as illustrated in FIGS. 3 and 6, in one embodiment, the locking elements 70 can include slotted spring pins that can contract or otherwise be reduced in size to facilitate their insertion into the attachment holes 57 and attachment apertures 67. The slotted spring pins 70 can then expand to hold the attachment end 64 of the feed ramp insert 60 firmly against the underside and interior axial surfaces 52 of the receiver 40 with a friction fit, while the free end 62 of the feed ramp insert 60 extends upward into the notch 28 formed into the proximal end face 27 of the barrel 20 (FIGS. 3-4A and 5A). This friction fit can be overcome with appropriate tooling when desired, so that the feed ramp insert 60 can be removed from the receiver 40 and replaced with another feed ramp insert having a similar body configuration or size so as to fit within the mating recess of the receiver, but formed with proximal feed ramp surfaces having different characteristics. For instance, and as discussed in more detail below, the proximal feed ramp surfaces 68 may be modified to accommodate different types ammunition, feed angles, and bullet types, as well as to extend the service life of the receiver 40 and the breech end 22 of the barrel 20.

Figure 4A:
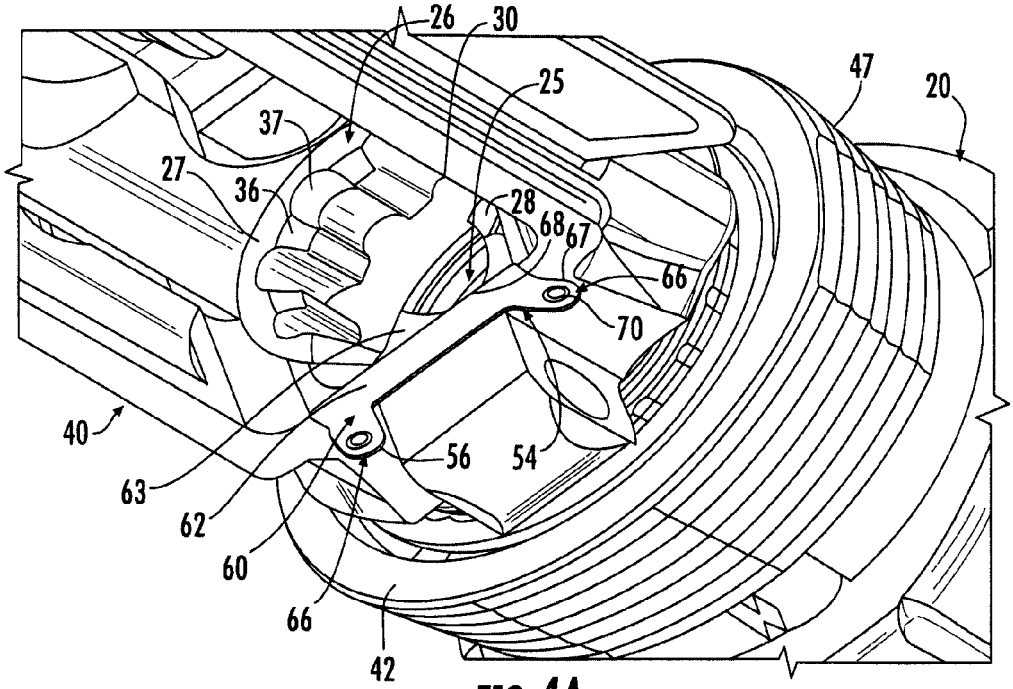
FIG. 4A is a perspective view of the underside of the receiver, illustrating the mounting of the feed ramp insert therein.
Figure 4B:
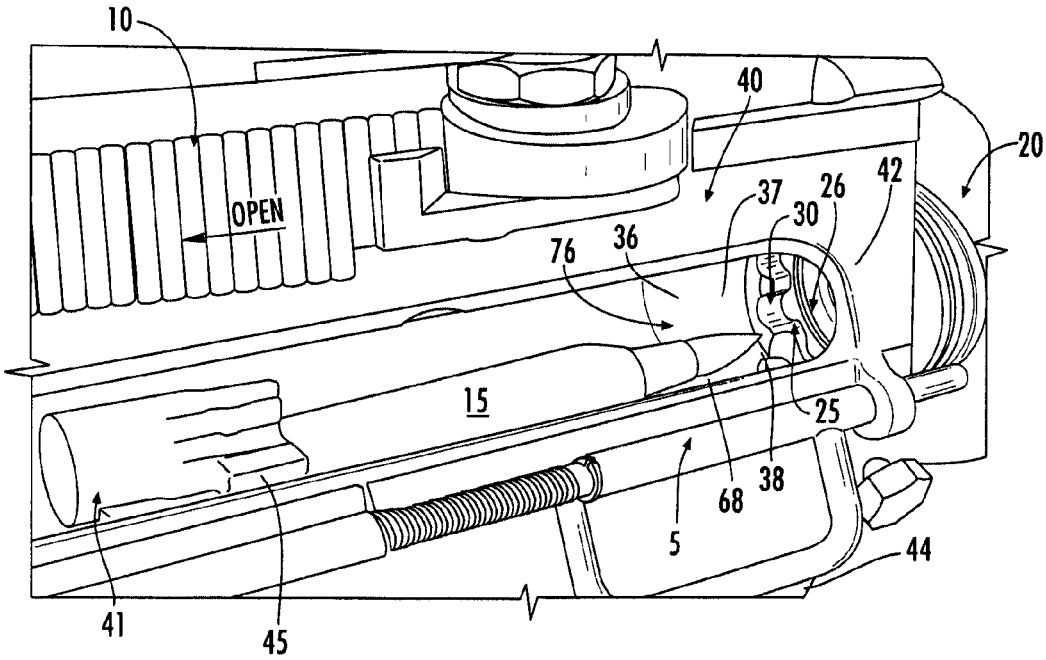
FIG. 4B is a perspective view illustrating the loading of a cartridge along the feed ramp system of FIGS. 2-4A.
Figure 8:
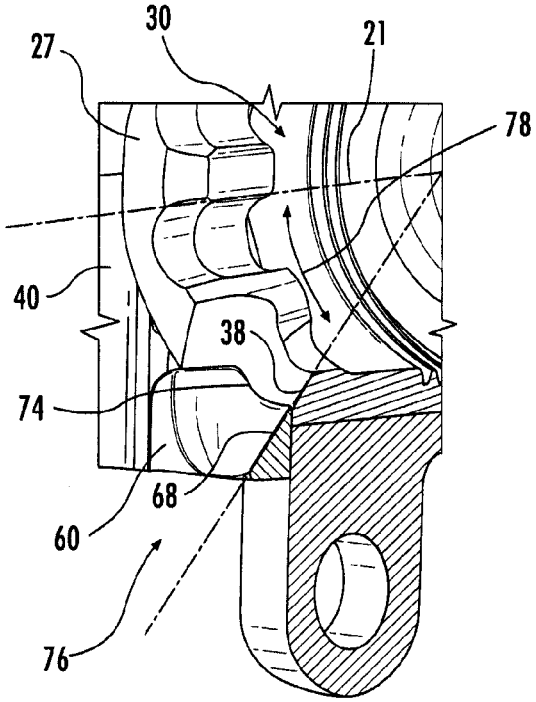
FIG. 8 is a perspective, cut-away view of one embodiment of the feed ramp system.

FIG. 7 is a cross-sectional end view of the assembled feed ramp system shown in FIG. 2, and generally illustrates the bifurcated or combination aspect of the firearm feed ramps 76 provided by the alignment and/or mating of the proximal ramp surfaces 68 formed into the feed ramp insert 60 with the adjacent distal ramp surfaces 38 formed into the breech face of the barrel extension 26. In one aspect, the proximal ramp surfaces 68 and the distal ramp surfaces 58 (FIG. 5B) can meet along a curved joint line 74 to form a substantially smooth and continuous feed ramp 76 from the lower edge of the proximal ramp surfaces 68 to the back edge of the distal ramp surfaces 38. For example, as shown in the FIG. 8, both the proximal ramp surfaces 68 and the distal ramp surfaces 38 can be formed with an approximately equivalent or substantially similar angle 78 relative to the longitudinal axis 21 of the barrel 20. Thus, each feed ramp 76 can comprise a curved surface with a substantially linear profile when viewed in cross-section. During loading, as indicated in FIGS. 2 and 4B, the tip of a cartridge 15 being loaded will first contact a proximal ramp surface 68 and then be guided linearly up the feed ramp 76, over a joint line 74 (FIG. 7), and across a distal ramp surface 38, through the breech opening 30 and into the chamber 25.

In one embodiment, the barrel 20 (FIG. 2) of the firearm can be made from a hardened steel alloy that has been treated to withstand the elements as well as the forces generated during repeated firings of the firearm. However, the receiver 40 can be made from other metallic or similar materials, such as aluminum alloys or other lightweight materials, so as to reduce the overall weight of the firearm. The feed ramp insert 60 of the present invention can be made from a different material that will be a higher strength metal or metal alloy materials, and generally will have a substantially higher impact toughness and strength than the material of the receiver. For example, the receiver can be made from a first metallic material (e.g., aluminum) while the feed ramp insert can be formed from a second metallic material (e.g., a steel, or aluminum alloy or other material) that is different from and is harder and/or has a greater impact toughness than the first metallic material of the receiver.

In one embodiment, the feed ramp can be formed from a similar hardened steel alloy material as the barrel 20, so that the proximal ramp surfaces 68 and the distal ramp surfaces 38 that together form the bifurcated feed ramps 76 have the approximately same surface hardness. Indeed, in other aspects it may also be desirable for the feed ramp insert 60 to be made from an alloy material that is harder and more impact resistant than the hardened steel alloy forming the barrel 20, so that the proximal ramp surfaces 68 have a surface hardness and impact resistance that is greater than that of the distal ramp surfaces 38. The use of such materials having higher or increased impact toughness can provide for smoother feeding of cartridges, while at the same time, reducing wear, peening and/or galling of its surfaces, thus potentially increasing the operating cycles of the firearm while reducing maintenance and polishing required for the feed ramps.

As can be seen in FIG. 7, in some embodiments of the feed ramp system the surface area of the proximal ramp surfaces 68 can be substantially equal to, or even greater than, the surface area of the distal feed ramp surface 38. As the cartridges entering the receiver 40 can vary slightly in their alignment, expanding the surface area of the proximal ramp surfaces 68 can increase the likelihood that the tips of the cartridges contact or impact a proximal ramp surface 68 first, prior to sliding up the bifurcated feed ramps 76 and across the distal ramp surfaces 38. This can be advantageous when the proximal ramp surfaces 68 are provided with a surface hardness and impact resistance that is greater than that of the distal ramp surfaces 38, thereby allowing for a substantial reduction in the wear that may otherwise take place on the components formed into the breech end 22 of the barrel 20.

The replaceable design of the feed ramp system of the present disclosure can enable the gun designer, manufacturer, or end user to control the preferred area of contact between the cartridge and the bifurcated feed ramps 76. For example, in one aspect the surface area of the pair of proximal ramp surfaces 68 can be greater than or about 40% of the total surface area of the pair of bifurcated feed ramps 76. In other embodiments, the surface area of the pair of proximal ramp surfaces 68 can be greater than or about 50% of the total surface area of the pair of bifurcated feed ramps 76, or even 60% of the total surface area of the pair of bifurcated feed ramps 76. Changes to the surface area of the proximal ramp surfaces 68 can be accomplished in a variety of ways, including changes in the thickness of the feed ramp insert 60 as well as changes in the shape or geometry of the proximal ramp surfaces 68.

Figure 9:
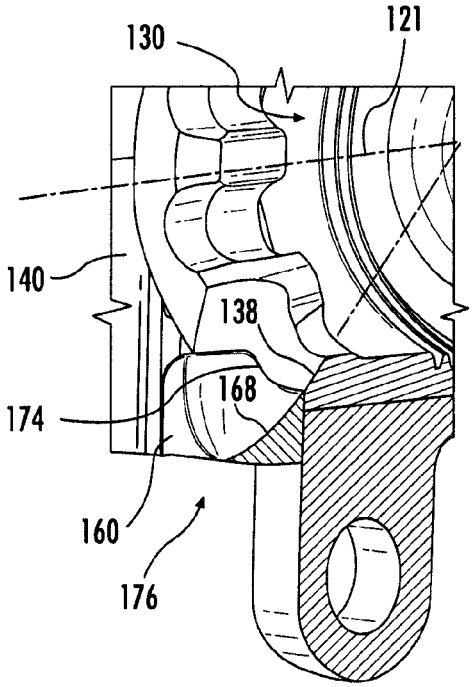
FIG. 9 is a perspective, cut-away view of the feed ramp system, in accordance with another representative embodiment of the present disclosure.

For instance, in another embodiment of the feed ramp system illustrated in FIG. 9, the proximal ramp surfaces 168 can be provided with a curved profile so that the tip of a cartridge being loaded through the breech 130 will first contact a proximal ramp surface 168 and then can rotate slightly as it slides up the feed ramp 176, over a joint line 174, and then follow a linear path as it slides across a distal ramp surface and into the chamber. In one aspect, the angle of the curved profile of the proximal ramp surface 168 relative to the longitudinal axis 121 of the barrel 120 may be configured to match or merge with the angle of the distal ramp surfaces 138 at the joint line 174, so that the movement across the joint line 174 remains substantially smooth and continuous.

Figure 10:
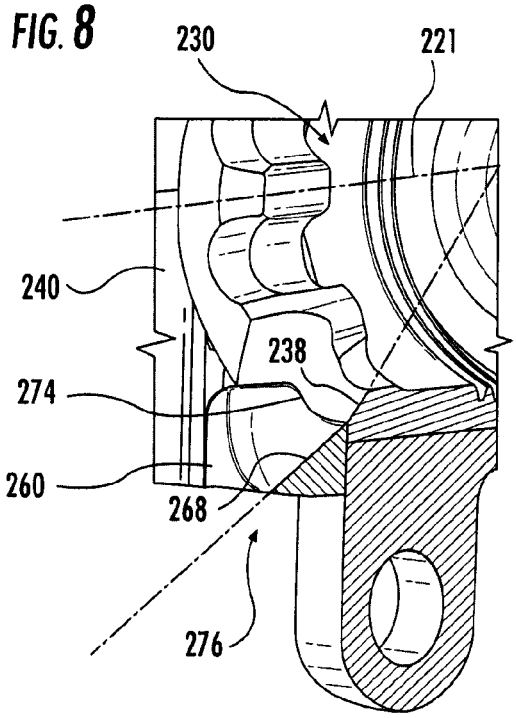
FIG. 10 is a perspective, cut-away view of the feed ramp system, in accordance with yet another representative embodiment of the present disclosure.

In yet another embodiment of the feed ramp system illustrated in FIG. 10, the proximal ramp surfaces 268 can be provided with a straight linear profile, but at an angle relative to the longitudinal axis 221 of the barrel 220 that is different than the angle of the distal ramp surfaces 238. In this configuration the tip of a cartridge being loaded through the breech opening 230 can experience a small or limited change of direction as it passes over the joint line 274.

The ability to quickly and easily replace the feed ramp, which thus enables the use of different configuration feed ramps in which various characteristics of the proximal feed ramp surfaces, including the surface hardness, the surface area, or the shape and geometry of the surface, and the like, can be modified, can allow for the rapid and efficient customization of the firearm to accommodate different types ammunition, feed angles, and bullet types. The ability to modify the proximal feed ramp surfaces can also extend the service life of the receiver and the breech end of the barrel, including the barrel extension. It is contemplated that these and other advantages may be realized upon practicing the present disclosure.

The invention has been described in terms of preferred embodiments and methodologies considered by the inventors to represent the best mode of carrying out the invention. A wide variety of additions, deletions, and modification might well be made to the illustrated embodiments by skilled artisans without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed:

1. A firearm, comprising:

a barrel assembly having a breech end at which a chamber is formed, the breech end comprising a plurality of radially spaced barrel lugs, and at least one distal ramp surface formed between selected ones of the barrel lugs;

a receiver having a forward end coupled to the barrel assembly adjacent the breech end of the barrel assembly; and a replaceable feed ramp insert comprising a body having at least one proximal ramp surface, and at least one attachment member projecting from the body and configured for releasably coupling the feed ramp insert in an engaged position between the receiver and the breech end of the barrel assembly, with the at least one proximal ramp surface substantially aligned with the at least one distal ramp surface of the barrel assembly so as to form at least one feed ramp for directing cartridges into the chamber of the firearm;

wherein the receiver comprises a mating aperture formed therein, and wherein the body of the feed ramp insert is configured to be received within the mating aperture of the receiver and comprises a pair of proximal ramp surfaces configured to align with corresponding ones of a pair of distal ramp surfaces of the barrel assembly to form a pair of feed ramps for directing cartridges into the chamber of the firearm.

2. The firearm of claim 1, wherein the receiver is made from a first metallic material and the feed ramp is made from a second metallic material that is different from the first metallic material.

3. The firearm of claim 1, wherein the distal ramp surfaces comprise a first surface hardness and the proximal ramp surfaces comprise a second surface hardness that is substantially equal to the first surface hardness.

4. The firearm of claim 1, wherein the distal ramp surfaces comprise a first surface hardness and the at least one proximal ramp surfaces comprise a second surface hardness that is different from the first surface hardness.

5. The firearm of claim 1, wherein the barrel assembly further comprises a barrel extension coupled to a barrel body adjacent the breech end of the barrel assembly, with the barrel extension defining the breech end of the barrel assembly including the barrel lugs and at least one distal ramp surface defined therein.

6. The firearm of claim 1, wherein a slope of the at least one proximal ramp surface of the feed ramp insert relative to a longitudinal axis of the barrel assembly is substantially equal to a slope of the at least one distal ramp surface of the barrel assembly.

7. The firearm of claim 1, wherein a surface area of at least one proximal ramp surface is greater than a surface area of at least one distal ramp surface.

8. The firearm of claim 1, wherein the breech end of the barrel assembly further comprises a breech face having a notch configured to releasably receive at least a portion of the body of the feed ramp insert therein.

9. A firearm, comprising:

a barrel assembly having a breech end at which a chamber is formed, the breech end comprising a plurality of radially spaced barrel lugs, and at least one distal ramp surface formed between selected ones of the barrel lugs;

a receiver having a forward end coupled to the barrel adjacent the breech end of the barrel; and a replaceable feed ramp insert comprising a body having at least one proximal ramp surface and configured for releasably coupling in an engaged position between the receiver and the breech end of the barrel, with the at least one proximal ramp surface substantially aligned with the at least one distal ramp surface of the barrel so as to form at least one feed ramp for directing cartridges in to the chamber of the firearm; and a pair of attachment members projecting on opposite sides of the feed ramp body, and wherein the feed ramp insert is mounted within the receiver by removable fasteners received through attachment holes formed in the pair of attachment members and corresponding fastener apertures of the receiver.

10. A firearm, comprising:

a barrel having a breech end at which a chamber is formed, and a circumferential rim defining a breech face and including a plurality of barrel lugs radially spaced thereabout, and a pair of distal ramp surfaces formed between selected ones of the barrel lugs;

a notch formed in the circumferential rim of the breech end of the barrel;

a receiver having a forward end configured to couple to the barrel and having a mating aperture formed adjacent the breech end of the barrel; and a feed ramp insert having a body configured to be matingly received within the mating aperture of the receiver and the notch of the barrel, with at least one attachment member projecting from the body for coupling the feed ramp insert to the receiver, and a pair of proximal ramp surfaces extending along the body and configured so as to substantially align with the distal ramp surfaces of the breech face to define feed ramps for directing cartridges into the chamber of the firearm;

wherein the feed ramp insert comprises a replaceable insert removably mounted between the receiver and barrel.

11. The firearm of claim 10, wherein a slope of the proximal ramp surfaces relative to the longitudinal axis is substantially equal to a slope of distal ramp surfaces.

12. The firearm of claim 10, wherein the pair of proximal ramp surfaces has a curved profile and the angle of the curved profile relative to the longitudinal axis is configured to match an angle of the pair of distal ramp surfaces.

13. The firearm of claim 10, wherein a slope of the proximal ramp surfaces relative to the longitudinal axis is not equal to a slope of distal ramp surfaces.

14. The firearm of claim 10, wherein the receiver is made from a first metallic material and the feed ramp is made from a second metallic material that is different from the first metallic material.

15. A firearm, comprising:

a barrel assembly having a breech end at which a chamber is formed, the breech end comprising a plurality of radially spaced barrel lugs, and a pair of feed ramp surfaces formed between selected ones of the barrel lugs;

a receiver having a forward end coupled to the barrel assembly adjacent the breech end thereof; and a replaceable feed ramp insert comprising a body configured for releasably fitting in an engaged position between the receiver and the breech end of the barrel assembly, the body including at least one ramp surface of the feed ramp insert substantially aligned with at least one of the feed ramp surfaces of the barrel so as to form at least one feed ramp for directing cartridges into the chamber;

wherein the receiver includes an aperture configured to receive at least a portion of the body of the feed ramp insert therein so as to locate and mount the feed ramp in its engaged position between the receiver and the breech end of the barrel assembly.

16. The firearm of claim 15, wherein the barrel assembly comprises a barrel body and a barrel extension coupled to the barrel body adjacent the breech end of the barrel assembly, the barrel extension including the pair of feed ramp surfaces formed therein.

17. The firearm of claim 15, wherein the breech end of the barrel assembly further comprises a breech face having a notch configured to releasably receive at least a portion of the body of the feed ramp insert therein.

* * * * *